US008019598B2

(12) United States Patent
Sakurai et al.

(10) Patent No.: US 8,019,598 B2
(45) Date of Patent: Sep. 13, 2011

(54) PHASE LOCKING METHOD FOR FREQUENCY DOMAIN TIME SCALE MODIFICATION BASED ON A BARK-SCALE SPECTRAL PARTITION

(75) Inventors: Atsuhiro Sakurai, Ibaraki (JP); Steven Trautmann, Ibaraki (JP)

(73) Assignee: Texas Instruments Incorporated, Dallas, TX (US)

( * ) Notice: Subject to any disclaimer, the term of this patent is extended or adjusted under 35 U.S.C. 154(b) by 1856 days.

(21) Appl. No.: 10/714,174

(22) Filed: Nov. 14, 2003

(65) Prior Publication Data

US 2005/0010397 A1 Jan. 13, 2005

Related U.S. Application Data

(60) Provisional application No. 60/426,831, filed on Nov. 15, 2002.

(51) Int. Cl.
*G10L 19/14* (2006.01)

(52) U.S. Cl. ..... 704/211; 704/207; 704/500; 704/502; 704/503; 704/504

(58) Field of Classification Search ..... 704/207, 704/211, 500–504
See application file for complete search history.

(56) References Cited

U.S. PATENT DOCUMENTS 4,246,617 A * 1/1981 Portnoff ..... 360/32
5,842,172 A * 11/1998 Wilson ..... 704/503
5,920,840 A * 7/1999 Satyamurti et al. ..... 704/267
6,073,100 A * 6/2000 Goodridge, Jr. ..... 704/258
6,112,169 A * 8/2000 Dolson ..... 704/205
6,266,644 B1 * 7/2001 Levine ..... 704/503
6,526,325 B1 * 2/2003 Sussman et al. ..... 700/94
6,766,300 B1 * 7/2004 Laroche ..... 704/500

OTHER PUBLICATIONS

Julius O. Smith, Ill and Jonathan S. Abel, "Bark and ERB Bilinear Transforms", Nov. 1999, IEEE Transactions on Speech and Ausio Processing, vol. 7, No. 6. p. 697.*

Laroche, Improved Phase Vocoder Time-Scale Phase Modification of Audio, IEEE Transactions on Speech and Audio Processing, vol. 7, No. 3, May 1999.*

Justy W.C. Wong, et al.; *Fast Time Scale Modification Using Envelope-Marching Technique* (*EM-TSM*); Proc. of 1998 IEEE Int'l Symp. On Circuits & Systems (ISCAS), Monterey, CA, Jun. 1998, vol. 5, pp. 550-553.

Salim Roucos, et al.; *High Quality Time-Scale Modification for Speech*, Proc. ICASSP 1985, pp. 493-496.

* cited by examiner

*Primary Examiner* — Leonard Saint Cyr
(74) *Attorney, Agent, or Firm* — Robert D. Marshall, Jr.; W. James Brady; Frederick J. Telecky, Jr.

(57) ABSTRACT

This invention improves the perceived quality of frequency-domain time scale modification by selection of spectral bands used in phase locking based upon a Bark scale according to the variation in human hearing frequency response. A spectral peak is identified for each band. At these peaks the phases are rotated using the phase vocoder algorithm. For a few spectral lines near these peaks, the phase differences are copied from the non-rotated spectrum. The number selected is preferably 4. Remaining spectral lines within each spectral band located farther from the peak are phase rotated using the phase vocoder algorithm. The boundaries of the spectral bands may be adjusted based upon the digital audio data to maintain important frequency groups within the same spectral band.

6 Claims, 2 Drawing Sheets

PHASE LOCKING METHOD FOR FREQUENCY DOMAIN TIME SCALE MODIFICATION BASED ON A BARK-SCALE SPECTRAL PARTITION

CLAIM OF PRIORITY

This application claims priority under 35 U.S.C. 119(e)(1) from U.S. Provisional Application 60/426,831 filed Nov. 15, 2002.

TECHNICAL FIELD OF THE INVENTION

The technical field of this invention is that of digital audio processing.

BACKGROUND OF THE INVENTION

Time-scale modification (TSM) is an emerging topic in audio digital signal processing due to the advance of low-cost, high-speed hardware that enables real-time processing by portable devices. Possible applications include intelligible sound in fast-forward play, real-time music manipulation, foreign language training, etc. Most time scale modification algorithms can be classified as either frequency-domain time scale modification (sometimes known as phase vocoders) or time-domain time scale modification.

Frequency-domain time scale modification is based upon reconstruction of a signal from a short-time discrete Fourier transformation (ST-DFT) from the time domain to the frequency domain using overlapping windows. Upon reconstruction a different set of analysis windows enables time compression or time expansion. The phases of spectral lines must be rotated according to an estimate of their instantaneous frequencies. Time-domain time scale modification is similar but uses overlapping or adding signals in the time domain. Frequency-domain time scale modification is generally believed to provide higher quality for polyphonic sounds than time-domain time scale modification, which is believed more suitable for narrow-band signals such as voice. This advantage for polyphonic sounds is achieved at the expense of higher computational cost.

Frequency-domain time scale modification produces some characteristic artifacts in the reconstructed sound. These include reverberation and loss of sound presence. A speaker may appear farther from the microphone in the reconstructed sound than in the original audio. Some of these artifacts are believed introduced by lack of phase coherence between neighboring spectral lines. The quality of frequency-domain time scale modification can be significantly improved by repairing this phase incoherence. This technique is called phase locking. A common technique seeks local spectral peaks, partitions the spectrum into regions dominated by these peaks and then locks the phase of spectral lines of each region according to the peak. The locked phases are forced to keep the same relation as the input spectrum before phase rotation. In rigid phase locking this relation is fixed. In scaled phase locking this relation is scaled by a proportionality factor. These methods generally eliminate reverberation but introduce additional artifacts making the resultant sound seem artificial or synthetic. Some of this artificiality can be mitigated by control of the scaling factor, but the sound is generally perceived of low overall quality.

SUMMARY OF THE INVENTION

This invention improves the perceived quality of frequency-domain time scale modification with phase locking by selection of the spectral bands used in the phase locking. This invention uses spectral bands based upon a Bark scale. The Bark scale is based upon the variation in human hearing frequency response. Spectral bands selected with regard to the Bark scale produce a better quality result. In high frequencies where perceptual frequency resolution is low, there are fewer, wider spectral bands. Thus the phase locking is performed on a smaller number of spectral peaks. At lower frequencies where human hearing provides higher frequency resolution, there are more and narrower spectral bands.

The spectrum is partitioned into Bark scale spectral bands. A spectral peak is identified for each band. At these peaks the phases are rotated using the phase vocoder algorithm. For a few spectral lines near these peaks, the phase differences are copied from the non-rotated spectrum. The number selected could be 4 for a 1024-point spectrum. This is similar to rigid phase locking. For remaining spectral lines within each spectral band located farther from the peak, phases are rotated using the phase vocoder algorithm. The spectral band boundaries may be time varying dependent upon the input data to maintain important frequency groups in the same spectral band.

BRIEF DESCRIPTION OF THE DRAWINGS

These and other aspects of this invention are illustrated in the drawings, in which.

DETAILED DESCRIPTION OF PREFERRED EMBODIMENTS

Figure 1:
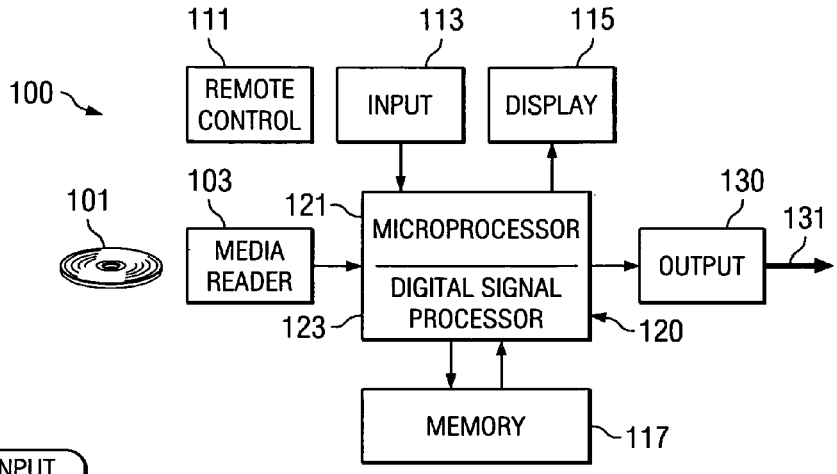
FIG. 1 illustrates a system to which the present invention is applicable.

FIG. 1 is a block diagram illustrating a system to which this invention is applicable. The preferred embodiment is a DVD player or DVD player/recorder in which the time scale modification of this invention is employed with fast forward or slow motion video to provide audio synchronized with the video in these modes.

System 100 received digital audio data on media 101 via media reader 103. In the preferred embodiment media 101 is a DVD optical disk and media reader 103 is the corresponding disk reader. It is feasible to apply this technique to other media and corresponding reader such as audio CDs, removable magnetic disks (i.e. floppy disk), memory cards or similar devices. Media reader 103 delivers digital data corresponding to the desired audio to processor 120.

Processor 120 performs data processing operations required of system 100 including the time scale modification of this invention. Processor 120 may include two different processors microprocessor 121 and digital signal processor 123. Microprocessor 121 is preferably employed for control functions such as data movement, responding to user input and generating user output. Digital signal processor 123 is preferably employed in data filtering and manipulation functions such as the time scale modification of this invention. A Texas Instruments digital signal processor from the TMS320C5000 family is suitable for this invention.

Processor 120 is connected to several peripheral devices. Processor 120 receives user inputs via input device 113. Input device 113 can be a keypad device, a set of push buttons or a receiver for input signals from remote control 111. Input device 113 receives user inputs which control the operation of system 100. Processor 120 produces outputs via display 115. Display 115 may be a set of LCD (liquid crystal display) or LED (light emitting diode) indicators or an LCD display screen. Display 115 provides user feedback regarding the current operating condition of system 100 and may also be used to produce prompts for operator inputs. As an alternative for the case where system 100 is a DVD player or player/recorder connectable to a video display, system 100 may generate a display output using the attached video display. Memory 117 preferably stores programs for control of microprocessor 121 and digital signal processor 123, constants needed during operation and intermediate data being manipulated. Memory 117 can take many forms such as read only memory, volatile read/write memory, nonvolatile read/write memory or magnetic memory such as fixed or removable disks. Output 130 produces an output 131 of system 100. In the case of a DVD player or player/recorder, this output would be in the form of an audio/video signal such as a composite video signal, separate audio signals and video component signals and the like.

Figure 2:
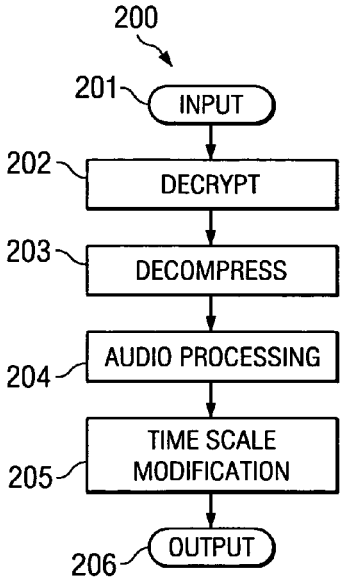
FIG. 2 is a flow chart illustrating the major functions of digital audio processing in the system illustrated in FIG. 1.

FIG. 2 is a flow chart illustrating process 200 including the major processing functions of system 100. Flow chart 200 begins with data input at input block 201. Data processing begins with an optional decryption function (block 202) to decode encrypted data delivered from media 101. Data encryption would typically be used for control of copying for theatrical movies delivered on DVD, for example. System 100 in conjunction with the data on media 101 determines if this is an authorized use and permits decryption if the use is authorized.

The next step is optional decompression (block 203). Data is often delivered in a compressed format to save memory space and transmit bandwidth. There are several motion picture data compression techniques proposed by the Motion Picture Experts Group (MPEG). These video compression standards typically include audio compression standards such as MPEG Level 3 commonly known as MP3. There are other audio compression standards. The result of decompression for the purposes of this invention is a sampled data signal corresponding to the desired audio. Audio CDs typically directly store the sampled audio data and thus require no decompression.

The next step is audio processing (block 204). System 100 will typically include audio data processing other than the time scale modification of this invention. This might include band equalization filtering, conversion between the various surround sound formats and the like. This other audio processing is not relevant to this invention and will not be discussed further.

The next step is time scale modification (block 205). This time scale modification is the subject of this invention and various techniques of the prior art and of this invention will be described below in conjunction with FIGS. 3 to 6. Flow chart 200 ends with data output (block 206).

Figure 3:
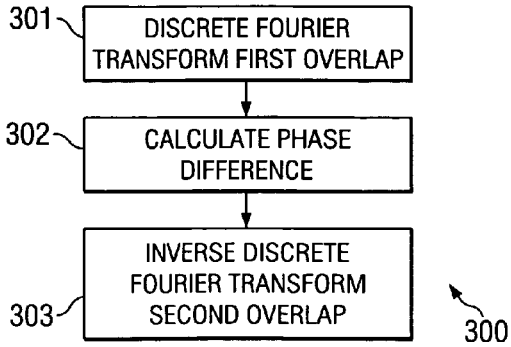
FIG. 3 (PRIOR ART)
FIG. 3 is a flow chart illustrating the steps in the prior art phase vocoder time scale modification technique.
Figure 4:
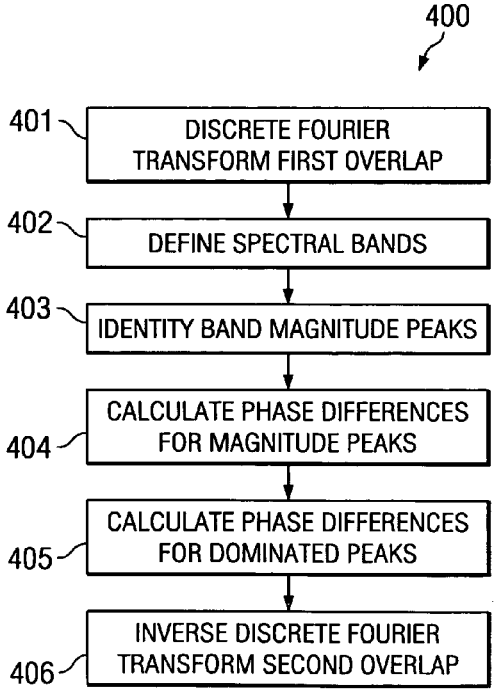
FIG. 4 (PRIOR ART)
FIG. 4 is a flow chart illustrating the steps in the prior art phase-locked phase vocoder time scale modification technique.

FIG. 3 is a flow chart illustrating process 300 including the basic phase vocoder as known in the art. At block 301 the input signal is analyzed at equally spaced overlapping windowed frames using a short-time discrete Fourier transform. The resulting data describes short time intervals of the audio data in the frequency domain. Next the phase difference for spectral peaks is calculated (block 302). This phase difference is the difference in phase between an input phase and a time scale modified signal phase. Block 302 uses an intrinsic sinusoidal model where the frequency is represented by the sum $\Omega_k+\omega_{ik}$: where carrier $\omega_k$ is $2\pi k/N$; and $\omega_{ik}$ is an instantaneous frequency modulator. Block 302 estimates $\omega_{ik}$ for each spectral line by obtaining the phase difference between two consecutive analysis frames. Here, k is the spectral line and N is the size of the short-time discrete Fourier transform.

Process 300 reconstructs an output signal from the analyzed frames using a short-time inverse discrete Fourier transform (block 303). The frames are overlapped by a different overlap factor to achieve the desired time scaling. The instantaneous frequency $\omega_{ik}$ is used to calculate the phase corresponding to each spectral line in the time shifted instant.

This prior art phase vocoder produces acceptable output quality for small scaling rates up to about 40% to 50% depending on the source audio and the quality requirements. However, the reverberation introduced at higher scaling factors yields poor quality. Several known methods are proposed to eliminate this reverberation.

FIG. 400 is a flow chart illustrating process 400 which is an alternative frequency domain, time scale modification technique according to the prior art. At block 401 the input signal is analyzed at equally spaced overlapping windowed frames using a short-time discrete Fourier transform. The input audio spectrum is partitioned into plural spectral bands (block 402). Process 400 then identifies the spectral magnitude peaks for each of the bands (block 403). Process 400 then calculates the phase differences for these band peaks (block 404). Process 400 uses the same technique as used in block 302 to calculate these phase differences.

The prior art teaches two alternative techniques for calculating the phase differences for the dominated spectral peaks, those spectral peaks within each spectral band that are not the magnitude peak (block 405). These methods, known as phase locking, force adjacent spectral lines to retain a coherent phase relation. In rigid phase locking, the method calculates the phases of the dominated lines within the region by copying the phase difference between the input analysis frame and the output for the spectral peak. In scaled phase locking, the magnitude peaks are allowed to migrate to a different spectral line within the same region. The observed phase difference $\Phi_{ip}$ between consecutive frames for a given spectral region p is calculated as the difference between $\Omega_{k1}$ the phase of the magnitude peak for the previous frame and $\Omega_{k2}$ the phase of the magnitude peak for the current frame. The spectral peak located in line k1 in the previous frame is located in k2 in the current frame. A proportionality factor $\beta$ is introduced between the phase difference in the analysis frame and the synthesis frame. Process 400 ends with a short-time inverse discrete Fourier transform using a second set of overlaps to achieve the desired time scaling.

The Bark scale is an approximation of the critical bands in human hearing range reflecting the variation of hearing frequency response with frequency. This Bark scale is widely used in perceptual audio coding to model the effect of noise masking in different spectral regions.

Figure 5:
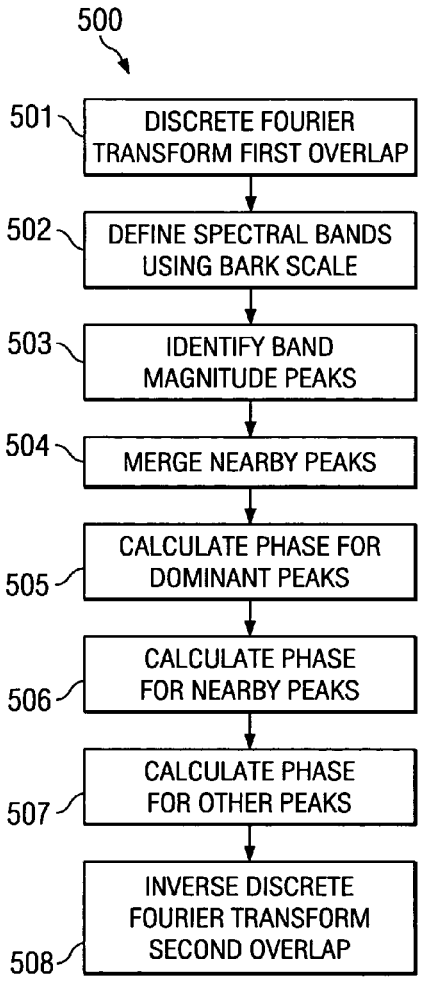
FIG. 5 is a flow chart illustrating the steps in the Bark scale spectrum partition phase vocoder time scale modification technique of this invention.

FIG. 5 is a flow chart illustrating process 500 according to this invention. The short-time discrete Fourier transform is calculated for overlapping analysis frames (block 501). This provides the magnitude and phase characteristics of the input audio signal. The spectrum is partitioned into plural bands using a Bark scale (block 502). Table 1 shows an example set of Bark bands for a 1024-point spectrum.

TABLE 1

| | | | | |
|---|---|---|---|---|
| 4 | 23 | 64 | 136 | 328 |
| 8 | 32 | 72 | 156 | 404 |
| 12 | 40 | 84 | 188 | 512 |
| 16 | 48 | 100 | 228 | 660 |
| 20 | 56 | 116 | 272 | 1024 |

Process 500 then determines magnitude peak within each band (block 503). Next, peaks that are too close to each other are merged (block 504). Process 500 calculates the phase difference for the dominant peaks according to the prior art phase vocoder technique (block 505). Next, process 500 calculates the phase difference for the adjacent dominated peaks (block 506). The phase of these peaks is locked to the phase of the corresponding dominant peak according to the rigid phase locking of the prior art. Empirical tests show that using four adjacent spectral lines yields good results. Process 500 calculates the phases of the remaining spectral peaks within each band upon synthesis using the conventional vocoder algorithm (block 507). Process 500 completes with the short-time inverse discrete Fourier transform having a second overlap to achieve the desired time scale modification (block 508).

This invention partitions the spectrum into regions of influence similar to scaled phase locking. There are two fundamental differences between this invention and known phase locking. First, the spectral regions are predetermined based upon the Bark scale rather than defined by bands including spectral peaks. Second, the phase locking is performed at only a few spectral lines, rather than for all spectral lines in the region. A typical application of this invention will phase lock only four spectral lines near the band peak. This invention yields the following advantages. The phase locking is performed for more peaks in spectral regions with more Bark scale bands and for fewer peaks with fewer Bark scale bands. This better distributes the computational resources to spectral regions more relevant to the hearer. This invention avoids excessive spectral manipulation particularly in wide Bark bands. This invention limits phase locking to spectral lines near the band peaks where phase coherence is more important. For spectral lines more distant from the peaks, conventional phase rotation results in better quality by avoiding the artificial or synthetic effect of phase locking.

The success of this method is based upon the use of Bark scale bands which are a better approximation of the human auditory system. Since the Bark bands approximate critical bands, it appears that maintaining phase coherence among peaks within critical bands is advantageous in sound quality. It also appears that maintaining phase coherence for masked frequencies is unimportant. Additionally, phase coherence between critical bands also appears less important.

Figure 6:
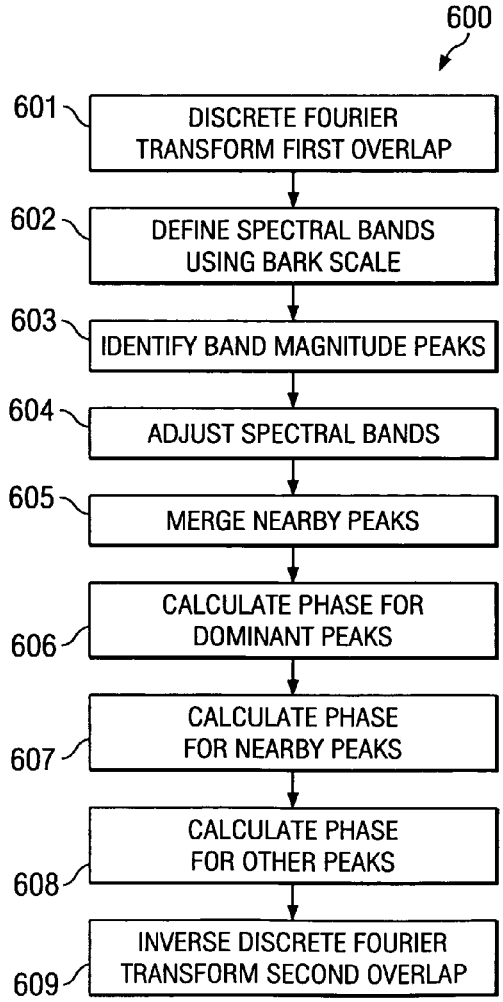
FIG. 6 is a flow chart illustrating the steps in a modification of the invention illustrated in FIG. 5.

This analysis suggests a further refinement of this invention. FIG. 6 illustrates this alternative process 600. The short-time discrete Fourier transform is calculated for overlapping analysis frames (block 601). The spectrum is partitioned into plural bands using a Bark scale (block 602) such as shown in Table 1. Processes 600 then determines magnitude peak within each band (block 603). Block 604 adjusts the spectral bands based upon the identified spectral lines in block 603. The goal of the band adjustment is to maintain important frequency groups within a single band while generally maintaining the relation to human frequency response. Placing important frequency groups in the same band means the technique produces phase coherence within these groups, while putting them in different bands would not guarantee phase coherence. In some cases flexible band boundaries will yield better results.

Process 600 continues as described above in conjunction with process 500. Peaks that are too close to each other are merged (block 605). Processor 600 calculates the phase difference for the dominant peaks as previously described (block 606). Process 600 calculates the phase difference for the adjacent dominated peaks (block 607) by rigid phase locking to the corresponding dominant peak. Process 600 calculates the phases of the remaining spectral peaks within each band upon synthesis using the conventional vocoder algorithm (block 608). Process 600 completes with the short-time inverse discrete Fourier transform having a second overlap to achieve the desired time scale modification (block 609).

What is claimed is:

1. A method of converting an input digital audio signal into an output digital audio signal having a modified time scale comprising the steps of:

receiving input digital audio data having a first time scale;

calculating a discrete Fourier transform of first equally spaced, overlapping time windows having a first overlap amount of the input digital audio signal;

partitioning the spectrum into a plurality of contiguous spectral bands according to a Bark scale where each spectral band has an extent dependent upon human frequency perception;

identifying a dominant spectral line having the greatest magnitude within each spectral band;

calculating a phase difference for the dominant spectral line of each spectral band by a phase vocoder algorithm;

calculating a phase difference for each of a predetermined number of spectral lines near the dominant spectral line within each spectral band as the phase difference of the corresponding dominant spectral line;

calculating a phase difference for other spectral lines of each spectral band by the phase vocoder algorithm;

calculating an inverse discrete Fourier transform resulting in equally spaced, overlapping time windows having a second overlap amount employing the calculated phase difference for each spectral line thereby producing the output digital audio signal, the second overlap selected having a ratio to the first overlap amount to achieve a desired time scale modification; and converting the output digital audio signal into sound having a second time scale according to the desired time scale modification.

2. The method of claim 1, further comprising the step of:

merging nearby spectral lines that are within a predetermined frequency range of each other prior to calculating the phase difference.

3. The method of claim 1, wherein:

said step of partitioning the spectrum into a plurality of contiguous spectral bands according to a Bark scale includes adjusting boundaries of spectral bands to maintain important frequency groups within the same spectral band.

4. A digital audio apparatus comprising:

a source of a digital audio signal;

a digital signal processor connected to said source of a digital audio signal programmed to perform time scale modification on the digital audio signal by calculate a discrete Fourier transform of first equally spaced, overlapping time windows having a first overlap amount, partition the spectrum into a plurality of contiguous spectral bands according to a Bark scale where each spectral band has an extent dependent upon human frequency perception, identify a dominant spectral line having the greatest magnitude within each spectral band, calculate a phase difference for the dominant spectral line of each spectral band by a phase vocoder algorithm, calculate a phase difference for each of a predetermined number of spectral lines near the dominant spectral line within each spectral band as the phase difference of the corresponding dominant spectral line;

calculate a phase difference for other spectral lines of each spectral band by the phase vocoder algorithm, and calculate an inverse discrete Fourier transform using equally spaced, overlapping time windows having a second overlap amount employing the calculated phase difference for each spectral line thereby forming a time scale modified digital audio signal, the second overlap selected having a ratio to the first overlap amount to achieve a desired time scale modification; and an output device connected to the digital signal processor for outputting the time scale modified digital audio signal.

5. The digital audio apparatus of claim 4, wherein:

said digital signal processor is further programmed to merge nearby spectral lines that are within a predetermined frequency range of each other prior to calculating the phase difference.

6. The digital audio apparatus of claim 4, wherein:

said digital signal processor is programmed to partition the spectrum into a plurality of contiguous spectral bands by adjusting boundaries of spectral bands to maintain important frequency groups within the same spectral band.

* * * * *